US009382027B2

(12) United States Patent
Stoiber

(10) Patent No.: US 9,382,027 B2
(45) Date of Patent: Jul. 5, 2016

(54) DEVICE FOR THE TRANSFER OF FITTING PARTS FOR CONTAINER LABELLING

(71) Applicant: Krones AG, Neutraubling (DE)

(72) Inventor: Christian Stoiber, Michelsneukirchen (DE)

(73) Assignee: KRONES AG, Neutraubling (DE)

( * ) Notice: Subject to any disclaimer, the term of this patent is extended or adjusted under 35 U.S.C. 154(b) by 679 days.

(21) Appl. No.: 13/727,638

(22) Filed: Dec. 27, 2012

(65) Prior Publication Data

US 2013/0170930 A1 Jul. 4, 2013

(30) Foreign Application Priority Data

Dec. 30, 2011 (EP) ..... 11196198

(51) Int. Cl.
*B65C 9/04* (2006.01)
*B65C 9/14* (2006.01)
*B65C 9/16* (2006.01)

(52) U.S. Cl.
CPC ... *B65C 9/04* (2013.01); *B65C 9/14* (2013.01); *B65C 9/16* (2013.01)

(58) Field of Classification Search
CPC ..... B65C 9/04; B65C 9/14; B65C 9/16
See application file for complete search history.

(56) References Cited

U.S. PATENT DOCUMENTS 3,546,047 A * 12/1970 Dullinger ..... 156/571
3,594,258 A * 7/1971 Dullinger ..... 156/570
3,736,213 A * 5/1973 Jorss et al. ..... 156/570
4,361,460 A 11/1982 Kronseder
4,445,961 A 5/1984 Kronseder et al.
4,981,547 A 1/1991 Zodrow et al.
5,286,333 A * 2/1994 Orlandi ..... 156/570
7,497,323 B2 3/2009 Davidson et al.

FOREIGN PATENT DOCUMENTS

DE 3044879 A1 6/1982
DE 3216138 A1 11/1983
DE 19758799 B4 3/2008
EP 0341400 A2 11/1989
WO WO 2005115848 A2 12/2005

* cited by examiner

*Primary Examiner* — Mark A Osele
*Assistant Examiner* — Christopher C Caillouet
(74) *Attorney, Agent, or Firm* — Leydig, Voit & Mayer, Ltd.

(57) ABSTRACT

A device for transferring fitting parts for container labelling includes a hub coupled centrally and directly to a direct drive so as to be rotationally driven by the direct drive around a rotational axis in a stationary hub bearing arrangement disposed in an outer circumferential region of the hub. A plurality of drive shafts are rotatably mounted near an outside circumference of the hub. Each drive shaft is parallel to the rotational axis and coupled to a respective transfer shaft carrying a transfer element. A lantern wheel is disposed underneath the hub. The lantern wheel includes drive pinions and toothed wheel segments disposed on the drive shafts and a stationary control cam plate for pivotally rotating the drive shafts with rotation of the hub. The direct drive is disposed underneath the control cam plate.

14 Claims, 1 Drawing Sheet

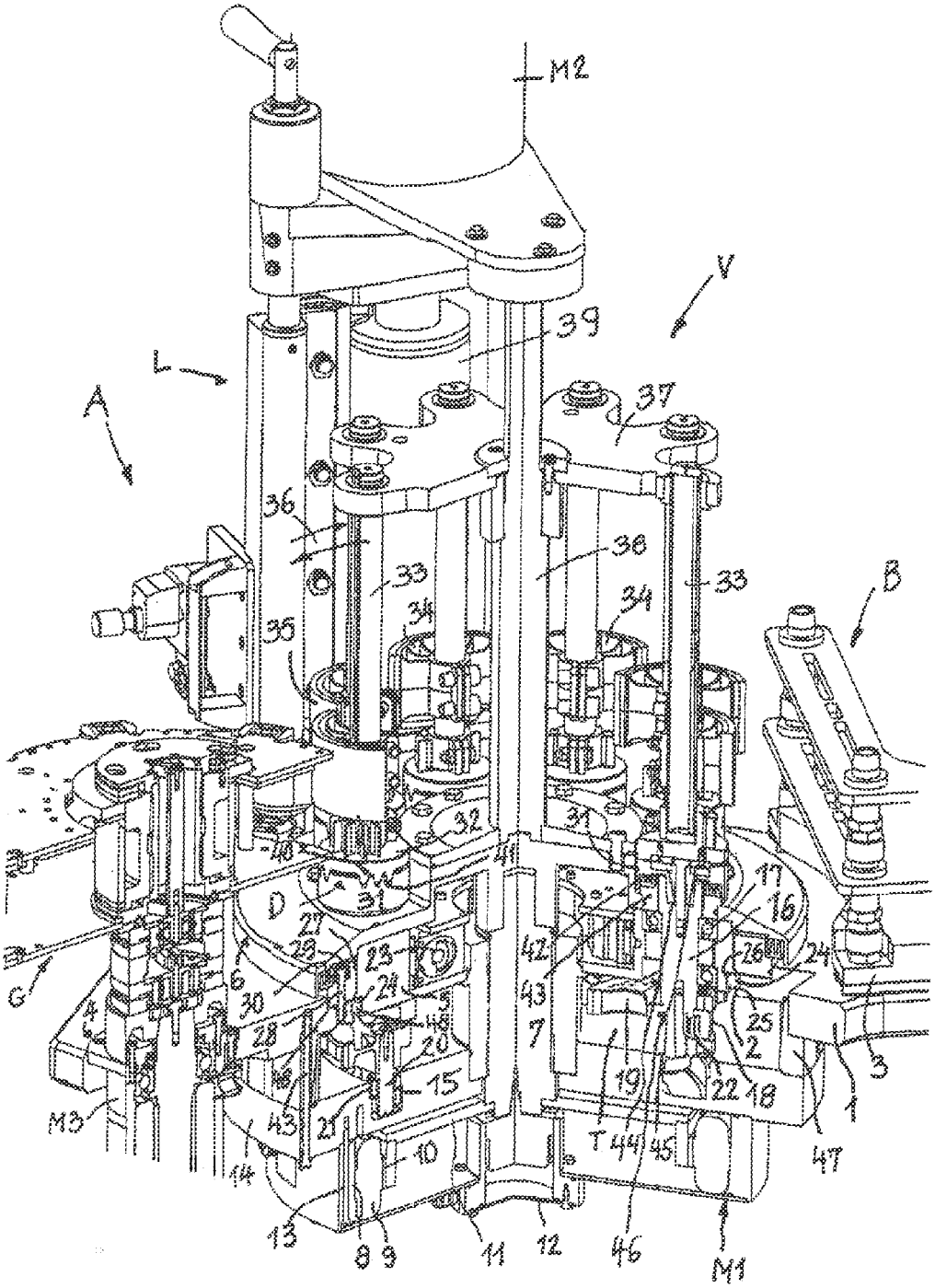
M2
V
39
L
A
37
36
38
33
34
B
35
32
31
D
27
29
23
24
6
30
28
20
15
43
21
10
14
13
8 9
11
12
46
M1
42
43
7
19
T 44
45
22
18
17
16
26
25
2
3
1
47
G
4
M3

DEVICE FOR THE TRANSFER OF FITTING PARTS FOR CONTAINER LABELLING

CROSS REFERENCE TO RELATED APPLICATIONS

This application claims priority to European Patent Application No. EP 11 196 198.3, filed Dec. 30, 2011, which is hereby incorporated by reference herein in its entirety.

FIELD

The invention relates to a device for the transfer of fitting parts for container labelling.

BACKGROUND

A device of this kind which can be attached to a labelling assembly and which is known from DE 30 44 879 A and DE 32 16 138 A has a stationary gearbox housing whose bottom forms the cam control plate of the lantern wheel, said gearbox being sealed on the upper side between a cover of the hub and the gearbox housing via a slide ring seal, because at least the lantern wheel arranged between the hub and the cam control plate runs in an oil bath. Mounted centrally on the cam control plate is a stationary axle on which the hub is rotatably supported centrally by means of two axially spaced roller bearings. The hub has a peripheral tooth profile meshing with a drive gear wheel of a gearbox forming the drive of the device. Each of the drive shafts in the hub has, on its lower end, a drive pinion mounted for co-rotation and a pivotable toothed wheel segment of the lantern wheel, whereby each toothed wheel segment meshes with the drive pinion of the next following drive shaft, and also engages with guiding rollers in a groove-like control cam that is continuous in the circumferential direction, and, during the rotational movement of the hub, turns the drive shaft rotating with the hub back and forth in an oscillating manner. At the upper end of each drive shaft is arranged a rotating joint part that penetrates the cover of the hub, that must be sealed therein, and that has an axial polygonal stab bore into which a polygonal end of the transfer shaft is inserted. In the case of the device known from DE 32 16 138 A, e.g., an individual temporary switch-off of each drive shaft is provided, whereby said switch-off includes a twist-lock pneumatic cylinder in the hub close to the respective drive shaft and an overload clutch provided between a land of the drive shaft and a spring-loaded sliding collar, that separates, as needed, the rotating joint part of the drive shaft from the drive shaft. The configuration of the device is complicated and results in a large overall height in the direction of the rotational axis, so that considerable mounting space is required above a support structure in a labelling assembly. Furthermore, the functional integration of the device into a toothed wheel drive system is required, which increases the constructional effort inexpediently and hinders a modular construction of the device independently from the labelling assembly, as well as barring individual rotational speed control of the hub. One reason, among others, for the large overall height of the known device is that a great deal of space is required above the hub in the direction of the rotational axis due to the central bearing arrangement of the hub, which requires a stable construction, and due to the overload clutch of the individual switch-off, said overload clutch occupying considerable height.

SUMMARY

In an embodiment, the present invention provides a device for transferring fitting parts for container labelling including a hub coupled centrally and directly to a direct drive so as to be rotationally driven by the direct drive around a rotational axis in a stationary hub bearing arrangement disposed in an outer circumferential region of the hub. A plurality of drive shafts are rotatably mounted near an outside circumference of the hub. Each drive shaft is parallel to the rotational axis and coupled to a respective transfer shaft carrying a transfer element. A lantern wheel is disposed underneath the hub. The lantern wheel includes drive pinions and toothed wheel segments disposed on the drive shafts and a stationary control cam plate for pivotally rotating the drive shafts with rotation of the hub. The direct drive is disposed underneath the control cam plate.

BRIEF DESCRIPTION OF THE DRAWINGS

Exemplary embodiments of the present invention are described in more detail below with reference to FIG. 1, which shows a perspective view, partially in a sectional view, of a device, for example, integrated into a labelling assembly, the device being for the transfer of fitting parts during container labelling

DETAILED DESCRIPTION

An aspect of the invention is related to simplifying constructionally and functionally and forming compactly with a low overall height a device of the type mentioned at the beginning, as well as making it possible to integrate said device easily into a labelling assembly in a modular manner.

Because the hub is coupled centrally and directly with a direct drive, the device can be simplified constructionally and designed as a constructional unit that can be integrated modularly into different types of labelling assemblies. The direct drive of the hub from below makes the device independent of any drive systems of the labelling assembly. It is possible to adapt and to vary the rotational speed of the hub sensitively to the respective requirements. Rotatably supporting the hub in the circumferential region of the hub saves considerable overall height and mounting space in the centre, because the bearing arrangement supports the hub very stably with minimum space requirements, so that the individual components of the lantern wheel and of the drive shafts can be accommodated axially in a space-saving manner.

In the case of an expedient embodiment, the hub bearing arrangement and the hub are arranged in a through hole of a plate-like support structure of the device, the lantern wheel is arranged underneath the support structure, the direct drive is mounted on the control cam plate, and a drive train with a central shaft, said drive train connecting the direct drive to the hub, penetrates the lantern wheel centrally. In this way, a considerable portion of the device remains below the support structure, so that the device, when integrated into a labelling assembly, requires only minimum overall height above the support structure. The support structure can thereby belong only to the device, or it can be a support structure of the labelling assembly and/or, preferably, it can even support further fitting components of the labelling assembly. The support structure can be an easy-to-manufacture steel plate, which is lighter and more economical than a cast, complex gearbox housing, and it can, for example, absorb reactive forces of the hub bearing arrangement directly.

Particularly expediently, the direct drive is an electric torque motor or an electric servomotor. Such motors, for example, asynchronous motors with permanent magnet excitation, thus are capable of being speed-regulated sensitively, generate high torques and are very compact and stationary.

In particular, a flat-design disc-shaped torque motor is expediently provided as the direct drive of the device. This motor has a coil-containing stator, e.g., mounted on the bottom side of the control cam plate of the lantern wheel or on the support structure, and an interior rotor that is equipped with magnets and mounted directly on the central shaft of the hub and that, preferably, is supported via the hub by the hub bearing arrangement and consequently in the support structure itself. In this way, constructionally complex and space-consuming toothed gear systems with bearings for driving the hub are eliminated. Furthermore, the torque motor can be exchanged easily and swiftly in the event of a disturbance or damage.

In the case of a further, particularly expedient embodiment of the device, an individual switch-off, preferably capable of pneumatic activation, with an overload clutch is provided for each drive shaft in the hub. With the overload clutch, in the event of activated individual switch-off, a rotating joint part of the rotating joint, said rotating joint part projecting above the hub and said rotating joint being provided for coupling with the transfer shaft, can be decoupled from the drive shaft, while the drive shaft continues to execute the oscillating movement transmitted from the toothed wheel segment, without, however, rotating the coupled transfer shaft. Preferably, the overload clutch has spring-preloaded detent balls and detent ball recesses, each between the drive pinion rotatably arranged on the drive shaft and the drive shaft itself, whereby mounting space already available in this region of the lantern wheel is used for the accommodation of the overload clutch, which benefits the overall height of the device.

A particularly important concept is that used as the rotating joint is a free-of-play, self-centering front sprocket coupling that can be detached from and engaged into the rotating joint by means of a relative tipping movement of the transfer shaft oriented crosswise to the axis of the rotating joint. Transfer shafts are conventionally so-called exchangeable fittings that, e.g., must be exchanged in the event that there is an upcoming change of the type of the fitting parts. Because each transfer shaft with the transfer element has a substantial weight, and in the case of an exchange until now had to be raised or lowered manually relatively far by personnel, the front sprocket coupling that can be detached and engaged with a relative tipping movement of the transfer shaft crosswise to the axis of the rotating joint only. This concept creates a substantial improvement with regard to ergonomics and user-friendliness. The self-centering effect produces, in a practically effortless manner, the necessary centering between the drive shaft and the transfer shaft. Because it is important to mount each transfer element in the device in a specific rotational position, the front sprocket coupling is preferably formed with Hirth-toothings that can be engaged only in a single relative rotational position. An important advantage of a front sprocket Hirth-coupling furthermore lies in the fact that it requires only little overall height in the direction of the axis.

In the case of a further expedient embodiment, a cover that is penetrated by the drive shafts is provided on the upper side of the hub, whereby this cover covers the edge of the through hole of the support structure and is sealed with respect to the support structure by a circumferential labyrinth seal, so that here no impurities can penetrate into the interior of the device. The labyrinth seal furthermore offers the advantage of a practically frictionless sealing effect, so that no, or only a negligible, drag torque has to be overcome in the labyrinth seal. The labyrinth seal furthermore features a long service life with consistently high sealing quality.

In the case of a further expedient embodiment, each drive shaft that projects over the upper side of the hub or of a cover arranged on the hub is sealed with respect to the hub or to the cover by means of a labyrinth seal. This labyrinth seal is preferably arranged between the rotating joint part on the drive shaft and a sealing ring, e.g., a bearing ring, mounted in the cover. Because the labyrinth seal produces its sealing effect largely without friction, it does not generate any unwanted drag torque.

The constructional configuration of the device is simple if the control cam plate of the lantern wheel is mounted on the bottom side of the support structure, above a spacer ring that seals the lantern wheel with respect to the outside.

A particularly important concept is that the pivotal rotatable hub bearing arrangement has at least one, preferably only a single, four-point torque mounting element with balls and without a bearing ring, whereby this four-point torque mounting element is mounted directly between bearing seats of the hub and in the through hole of the support structure. This modern bearing type results in a centre-less rotatable support of the hub in the support structure. The bearing seats fulfils the function of bearing rings, so that mounting space and overall height can be reduced. Because the rotatable hub support works on an optimally large diameter, not only is the hub perfectly supported, where applicable, the armature of the direct drive is also stably supported via the hub.

In order to be able to adjust optimally the hub bearing arrangement that is operating on such a large diameter, in the case of a further embodiment, adjacent to the bearing seats, in a seat of the through hole of the support structure, a stationary clamping ring that loads the four-point torque mounting element with a spring preload is mounted, preferably with clamping screws and spring sets distributed in the circumferential direction of the support structure. The clamping ring can adjust the four-point torque mounting element with a spring bias that can be apportioned in such a manner that the balls run cleanly and without play. The clamping ring is furthermore favourable in terms of assembly.

In the case of a further expedient embodiment, the clamping ring of the hub bearing arrangement even takes over a further function if it is formed with a seat for the labyrinth seal on the circumferential side, between the cover of the hub and the support structure.

As mentioned, it is particularly expedient if, on the support structure of the device, in a geometric arrangement to the hub, at least one attachment area for a gripper cylinder and/or for a glue unit and/or for a fitting magazine is provided, so that the labelling assembly can be set up from or changed modularly with individual modules.

Finally, it is expedient to use the overall height present in the hub between two axially spaced roller bearings that rotatably support the drive shaft in a gainful manner for the accommodation of twist-lock pneumatic cylinders of the individual switch-offs, one allocated to each drive shaft, in order to reduce the total overall height.

A device V, built up in FIG. 1 on a plate-like support structure 1 (steel plate or light metal alloy plate), for the transfer of fitting parts, e.g., during container labelling, is shown integrated into a labelling assembly A, although the device V with its plate-like support structure 1 could be a constructional unit that can be prefabricated independently and that possibly can be integrated into different labelling assemblies A. The device V is used for the transfer of individual fitting parts, for example, labels or tin foil cuttings or the like, in a rotational movement around an at least essentially vertical rotational axis.

In the exemplary embodiment shown in FIG. 1, further components of a labelling assembly A are already arranged, e.g., on the support structure 1, functionally and in specific mutual geometric relationships, namely a magazine B for fitting parts, a glue unit L for the provision and application, for example, of cold glue onto each transferred fitting part, and a gripper cylinder G for the take-over of the glued fitting parts and transfer and application on to containers (not shown). Alternatively, the transfer of the fitting parts could take place in the device V with vacuum application (not shown). Prefabricated attachment areas 3, 4 can be provided in the support structure 1 for such further fitting components of the labelling assembly A, and also for the glue unit L (whose attachment area cannot be seen in the FIGURE).

The plate-like support structure 1 has a circular through hole 2 in which a rotor-like hub 5 is rotatably supported. The hub 5 bears on the upper side a cover 6 that grips outwards beyond the edge of the through hole 2 but that does not touch the upper side of the support structure 1. The hub 5, with a central shaft 7 of a central drive train, is in a rotating union with a direct drive M1 mounted on the bottom side of the device. The direct drive M1 is, as shown, for example, an electric torque motor or (not shown) an electric servomotor. The further fitting components, such as, for example, the gripper cylinder G or the glue unit L, can likewise have direct drives, e.g., electric servomotors M2, M3.

In the case of the shown torque motor as the direct drive M1, this has a stator 8 in which coils 9 are contained, as well as an armature 11, here approximately cup-shaped, that is equipped with magnets 10 and that is, e.g., directly screwed to the central shaft 7 of the hub 5. The lower side of the direct drive M1 is sealed by a seal 12, in which media connections or the like can be provided. The stator 8 is immobilized with clamping screws 13, here on the bottom side of a cam control plate 14 of a mechanical lantern wheel T arranged between the direct drive M1 and the hub 5. The cam control plate 14 is itself immobilized in a sealed manner on the bottom side of the support structure 1 by means of a spacing ring 47 with clamping screws 43. The direct drive M1 could alternatively be mounted directly on the support structure 1.

In the cam control plate 14, a control cam 15 that is contiguous in the circumferential direction and that has a non-circular course is formed in as a U-shaped groove that is open at the top and that is used for oscillating movement control of each of a plurality of drive shafts 16 rotatably supported in the hub 5 on a common reference circle. Each drive shaft 16 is rotatably supported in the hub 5 with two axially spaced roller bearings 17, and each bears on the lower end a rotatable drive pinion 18 as well as a pivotable toothed wheel segment 19, whereby each toothed wheel segment 19 supported in a pivoting manner on the drive shaft 16 is in a drive connection with its circumferential teeth with the drive pinion 18 of the next following drive shaft 16. Each toothed wheel segment 19 has on its bottom side a spindle 20, with rotatably supported guiding rollers 21, which engage from above into the control cam 15. As the hub 5 rotates with the drive shafts 15 the toothed wheel segments 19 transmit back and forth pivoting movements derived via the guiding rollers 21 from the control cam 15 that drive the drive pinions 18 and, via these, the drive shafts 16.

In the shown embodiment, the device V is optionally equipped with an individual switch-off for each drive shaft 16. This means that, depending on the need, the respective drive shaft 16 can be halted in a specific rotational position in the hub 5, although the driving toothed wheel segment 19 still executes the pivoting movement. Belonging to the individual switch-off is a spring-preloaded overload clutch 22, that is equipped with balls and ball recesses 46, which are preloaded by means of a spring set, in the drive pinion 18 and on the drive shaft 16, and, that when engaged, transmits the rotational movement of the drive pinion 18 onto the drive shaft 16, and that, when disengaged, in contrast allows the drive shaft 16 to remain standing in a predetermined rotational position while the drive pinion 18 rotates relative to the drive shaft 16. Belonging to the individual switch-off are pneumatic locking cylinders 23 in the hub 5, each of which can engage with an arresting pin (not shown) into a recess of the drive shaft 16, in order to block this against a rotational movement in the hub 5, so that then the overload clutch 22 is disengaged against the spring load, until the pneumatic cylinder 23 again countermands the twist-lock of the drive shaft 16. In this regard, reference is made to DE 32 16 138 A, whose at least complete functional disclosure is hereby incorporated.

The hub 5 is rotatably supported in the through hole 2 of the support structure 1 far outside on the circumferential side with a hub bearing arrangement, expediently comprising at least one bearing-ring-free four-point torque mounting element with balls that are supported between, e.g., four areas, each diametrically opposite another in such a manner that they can roll. More precisely, a first outer bearing seat 25 is formed into the through hole 2 of the support structure 1, and a further bearing seat 26 is formed in the outside circumference of the hub 5 so that the support structure 1 and the hub 5 take over the function of bearing rings of the hub bearing arrangement 24. A bearing play and a proper pre-tensioning of the arrangement 24 can be accomplished by means of a clamping ring 27, which loads, with exactly pre-selectable pre-tension, the arrangement 24 of the four-point torque mounting element above the bearing seat 25 from above into a seat 48 in the through opening 2 of the support structure 1 (with axial play) by means of clamping screws 28 and spring sets 29 distributed across the circumference.

Between the cover 6 and the support structure 1, a labyrinth seal 30 is provided on the bottom side in the cover 6 on the circumferential side, whereby this labyrinth seal 30 is supported on the clamping ring 27 and consequently is able to utilize the elasticity of the spring set 29.

At the upper end of each drive shaft 16, a rotating joint part 31 of a rotating joint D is arranged, whereby the rotating joint part lies above the upper side of the cover 6 and is coupled to a matching rotating joint part 40 of a coaxial transfer shaft 33 of the device V via the rotating joint D. Provided on at least one of the transfer shafts 33 is a fitting part transfer element 34 that has a convexly curved transfer surface 35 to hold a fitting part that already has been taken over. If cold glue is being used, each transfer surface 35 receives, in the glue unit L, a glue application, by means of which a fitting part is removed from the magazine B and then transferred to the gripper cylinder G, at which grippers (not shown) pull the glued fitting part off and transfer it farther and finally apply it to a container. In the case of a transfer surface 35 that works with vacuum, the transfer element 34 is connected to a vacuum supply (not shown).

Each rotating joint D is formed as a front sprocket coupling with front sprockets 40, 41 on rotating joint parts 31, 32, especially with Hirth-serrations or toothings, so that the rotating joint D operates without play and is self-centering, and the transfer shaft 33 can be exchanged by means of a relative and horizontal tipping movement only (arrows 36) to engage and disengage the rotating joint D. The front sprockets 40, 41 are expediently formed in such a manner that the rotating joint D can be engaged in only a single relative rotational position.

Mounted on the cover 6 is a column 38 on which a supporting disc 37 with recesses on the circumferential side is guided in a manner that allows sliding, and in which the upper ends of the transfer shaft 33 are additionally supported. For an exchange of the transfer shafts 33, the support plate 37 is pulled up and, e.g., twisted around a division of its recesses on the circumferential side, so that the upper ends of the transfer shafts 33 lie free and can be removed and installed with horizontal tipping movements only (arrows 36) relative to the respective lower rotating joint part 31.

A glue roll 39 of the glue unit L expediently driven via the direct drive M2 (electric servomotor) can be seen, whereby this glue roll 39 applies glue upon a rolling movement of each transfer surface 35. The rolling movement of each transfer surface 35 is generated by the lantern wheel T with the rotation of the hub 5, especially by the toothed wheel segments 19 and the drive pinions 18, in such a way that no relative movements occur between the surface of the rotating glue roll 19 and the transfer surface 35. To this end, the direct drive M2 of the glue unit 19 can be controlled in such a manner that a synchronisation with the irregular rolling movement speed of the transfer surface 35 takes place.

Each drive shaft 16 is furthermore sealed with respect to the upper side of the cover 6 by means of a labyrinth seal 42. The labyrinth seal 42 is mounted in a seat in the bottom side of the rotating joint part 31 of the transfer shaft 33 and in a seat of a sealing ring 43 inserted into an opening of the cover 6.

The rotating joint D can furthermore have, in the engaged position, an axial securing element, for example, a magnetic axial securing element, with a magnetic ring mounted in the rotating joint part 31 and a counter-magnet or magnetic counter-piece 46 in the other rotating joint part 32. This axial securing element can be easily engaged and disengaged by means of the horizontal tipping movement (arrows 36), but provides sufficient holding force in order to keep, e.g., the transfer shaft 33 from automatically tipping away after the supporting disc 37 has been slid up.

During the operation of the device V, the interacting toothed wheel segments 19 and the drive pinions 18 generate, via the stationary control cam 15, relative to the rotating hub 5, the relative back and forth pivoting movements of the transfer shafts 33 needed for the gluing of the transfer surfaces 35, the takeover of the fitting parts from the magazine B and the handover to the gripper cylinder G. If the individual switch-off is activated for a transfer shaft 33, the transfer surface 35 remains motionless in the hub 5 in a predetermined rotational position, so that it runs past the magazine B and/or the glue unit L and/or the gripper cylinder G in order not to be glued and/or not to take over a fitting part from the magazine B.

While the invention has been particularly shown and described with reference to preferred embodiments thereof, it will be understood by those skilled in the art that various changes in form and details may be made therein without departing from the spirit and scope of the invention.

The invention claimed is:

1. A device for transferring fitting parts for container labelling, the device comprising:

a hub coupled centrally and directly to a direct drive so as to be rotationally driven by the direct drive around a rotational axis in a stationary hub bearing arrangement disposed in an outer circumferential region of the hub;

a plurality of drive shafts rotatably mounted near an outside circumference of the hub, each drive shaft being parallel to the rotational axis and coupled to a respective transfer shaft carrying a transfer element; and a lantern wheel disposed underneath the hub, the lantern wheel including drive pinions and toothed wheel segments disposed on the drive shafts and a stationary control cam plate for pivotally rotating the drive shafts with rotation of the hub, wherein the direct drive is disposed underneath the control cam plate, and wherein the direct drive is an electric torque motor or an electric servomotor, the torque motor having a stator and an interior rotor, the stator containing coils and being mounted on a bottom side of the control cam plate or of a plate-like support structure of the device, and the interior rotor being equipped with magnets and being directly mounted on the central shaft of the hub.

2. The device recited in claim 1, wherein the hub bearing arrangement and the hub are arranged in a through hole of the plate-like support structure of the device, the lantern wheel is arranged underneath the support structure, the direct drive is mounted on the control cam plate, and a drive train that directly connects the direct drive to the hub centrally penetrates the lantern wheel with a central shaft.

3. The device recited in claim 2, further comprising an attachment area for at least one of a gripper cylinder, a glue unit or a fitting part magazine of a labelling assembly that can be set up modularly on the support structure, the attachment area being disposed in a predetermined geometric relationship to the hub.

4. The device recited in claim 1, wherein each drive shaft in the hub includes a rotating joint part of the rotating joint that is provided for the coupling with the respective transfer shaft, each rotating joint part lying freely on the upper side of the hub, an individual switch-off with an overload clutch is provided and the overload clutch has spring-preloaded detent balls and detent ball recesses between the drive pinion and the drive shaft.

5. The device recited in claim 4, wherein a twist-lock pneumatic cylinder of the individual switch-off is arranged in the hub with every drive shaft and between two axially spaced roller bearings that form a rotatable support of the drive shaft.

6. The device recited in claim 1, wherein the rotating joint is a self-centering front sprocket coupling without play that is detachable and engaged by a relative tipping movement of the transfer shaft crosswise to the axis of the pivotal mounting, and wherein the rotating joint has Hirth-toothings in front sprockets that are engagable in only a single relative mutual rotational position.

7. The device recited in claim 1, further comprising a cover on an upper side of the hub that is penetrated by the drive shafts and that covers an edge of the through opening and that is sealed with respect to the support structure by a labyrinth seal on a circumferential side.

8. The device recited in claim 1, wherein each drive shaft that projects beyond an upper side of the hub or a cover arranged on the hub is sealed with respect to the cover by means of a labyrinth seal.

9. The device recited in claim 8, wherein each labyrinth seal is arranged between the rotating joint part of the drive shaft and a sealing ring mounted in the cover.

10. The device recited in claim 1, wherein the control cam plate is mounted on a bottom side of the support structure via a spacer ring that seals the lantern wheel with respect to the outside.

11. The device recited in claim 1, wherein the hub bearing arrangement has a single bearing-ring-free four-point torque mounting element with roller bodies that is mounted directly between bearing seats of the hub and in the through hole of the support structure.

12. The device recited in claim 11, wherein adjacent to the bearing seat, a stationary clamping ring that loads the four-point torque mounting element with a spring preload is mounted in a seat in the through hole of the support structure.

13. The device recited in claim 12, wherein the clamping ring has a seat for the labyrinth seal on a circumferential side.

14. The device recited in claim 12, wherein the clamping ring has a seat for the labyrinth seal on a circumferential side.

* * * * *